US005680107A

United States Patent [19]

Curiel

[11] Patent Number: 5,680,107

[45] Date of Patent: Oct. 21, 1997

[54] TEMPERATURE ACTUATED SPACING REGULATOR AND ALARM

[76] Inventor: Yoram Curiel, 1956 S. Nome St., Aurora, Colo. 80014

[21] Appl. No.: 319,596

[22] Filed: Oct. 7, 1994

[51] Int. Cl.[6] ..... G08B 17/00

[52] U.S. Cl. ..... 340/584; 374/188; 403/30

[58] Field of Search ..... 340/584, 593, 340/594; 374/187, 188, 195, 196; 116/102, 216; 403/27, 28, 30; 219/50

[56] References Cited

U.S. PATENT DOCUMENTS 4,125,180 11/1978 Roberts ..... 403/28 X 4,487,016 12/1984 Schwarz et al. ..... 60/204

4,512,699 4/1985 Jackson et al. ..... 403/28 X 4,702,439 10/1987 Kelley et al. ..... 403/30 X

*Primary Examiner*—Thomas Mullen

[57] ABSTRACT

Thermally induced movement between stacked conical, pyramidal "cones" and segments of such cones can be used to provide alarm signals and control the distance between and orientation of objects. Preferably, each of the stacked cones must have a lesser characteristic of thermal change than the cone next most proximate to the base cone.

19 Claims, 3 Drawing Sheets

TEMPERATURE ACTUATED SPACING REGULATOR AND ALARM

BACKGROUND OF THE INVENTION

Conical pyramidal etc. surfaces and shapes are well known in art, architecture and engineering and have been used for many purposes. Exemplary modern patents showing such usages include:

U.S. Pat. No. 4,512,699 issued to L. R. Jackson et al. This patent teaches a daze fastener for connecting structural elements with substantially different coefficients of thermal expansion. Layers of metal sheathing have aligned holes in the form of truncated cones. The fastener, one end of which has the form of the cone, is passed through the holes and screwed or riveted into place.

U.S. Pat. No. 4,125,180 issued to R. W. Roberts. It teaches a disconnect or power stop mechanism which de-clutches the driving and driven members of a refrigerant compressor in the event of unsafe temperature conditions. The clutching mechanism rests, when activated, on a frustoconical surface.

Swedish Patent Application No. 66615/74 by W. X. Colgrove teaches a heavy jacking device for extremely large loads utilizing thermal expansion of metals to provide the necessary jacking force. In one of the embodiments the force is provided horizontally along a plane (portion of a pyramid) and the lifting occurs because of the expansion of one element which forces a lifting body up the surface of the plane.

SUMMARY OF THE INVENTION

Alarms can be sounded, articles can be lifted or the distance between objects can be controlled by two or more stacked, normally pointed geometric forms (cones) and a temperature gradient input(s). Preferably a stacked cone is tightly fitted over a base cone and the base cone expands when heated while the stacked cone does not or curves inwardly, e.g., where the cone is a bimetallic layer. The expansion and contraction of the base cone causes movement of the stacked cone away from and toward the base of the base cone. The "cones" can be truncated vertically or horizontally and/or segmented. Therefore, their bases can have a variety of geometric configurations, e.g., square, round, etc. The cones can also be split. The gradient temperatures can be supplied by ambient conditions, electrical resistance heating, chemical heating, frictional heating, etc. The distance across the base of split cones can also be increased or decreased by heat or cooling input devices or nontemperature changing devices, e.g., a hydraulic or pneumatic element.

GENERAL DESCRIPTION OF THE INVENTION

The systems and devices of this invention can be used for a variety of purposes, such as sensors of ambient temperature change (no heating coils needed), as jacks, valve controllers, spacing regulators, and air foil surface contour modifiers. While electrical power will often supply the required heat to actuate a system, ambient chemical, nuclear or mechanically provided heat can also be used as indicated by the unit of FIG. 8. Such systems will normally sound alarms, turn emergency switches on and/or off, apply brakes and/or increase the distance between objects, e.g., fuel rods in a nuclear reactor.

The units can also be used for fine adjustment of distances between objects positioned by mechanical, hydraulic actuators, jacks, etc. Many other uses will come to mind after a reading of this document.

As used herein, the term "cones" includes a variety of shapes, e.g., whole cones, sectors or segments of structures similar in basic shapes to cones, e.g., squares, rectangles, octagons, ellipses and circles.

The bases can come to a centered or offset point or truncated surface, depending on the requirements of the system. However, symmetrical and top centered systems such as those shown in the Figures are preferred. Sector, i.e., "pie" shaped units or other units with the top of the cone off center are more complicated but can be utilized where proper alignment between the base and stacked cone sectors is maintained and can be ensured without inhibiting friction or component strain to the point of deformation, galling, etc. Operative systems include those where the base cone is the fixed element and the base moves or both move. Movement can be caused by the expansion or contraction of both cones. The stacked cone can be truncated down to, effectively, a ring.

The relative amount of movement between the base and stacked cone is controlled by several variables, e.g., the thermal expansion coefficient of the cone element and the angle of slope of the cones. The base cone will normally be designed to expand while the stacked cones or a cover cone will normally contract, neither expand nor contract, or expand minimally relative to the expansion of the base cone. Obviously, where the base cone contracts, the stacked cone (s) must contract even more. Further, where the base cone neither expands nor contracts, the next adjacent cone must contract to create movement. More preferably, the stacked cones have a low coefficient of thermal expansion (e.g., that of Invar steel) and the base cones have a much higher coefficient of thermal expansion.

The slope of the cone has a major influence on the relative amount of movement. A 45° slope provides an optimum blend between the force and linear motion. Smaller angles (i.e., 35 degrees) will provide more linear motion than a wider angle (i.e., 65 degrees).

Obviously, where the slope of the base cone is adjustable (see FIG. 4), the base width or diameter can be increased to lock the stacked cone in a particular location. The temperature control mechanism can then be turned off except for minor changes required by the effect of ambient temperature changes.

The base and stacked cone(s) surfaces should be smooth and in close contact. The hardness and thermal change characteristics of each cone should be uniform within the cone. Thus, the base cone surface must be very hard where the cone is to be used as a heavy duty jack. Preferably, a cone with a softer metal surface is used with a hard metal cone to reduce wear. Specialty metal combinations can be used to advantage on occasion. Thus, bimetallic metal base cones can be used where a nonlinear response is required. A and B metal devices, i.e., thermally responsive bimetallic elements, can be used where preferential expansion in one dimension is needed. Clad metals and sintered metal can be used to ameliorate lubrication, corrosion, etc. problems. The materials from which the cones are constructed are preferably metals but can be any materials which have the desired cone characteristics for the usage desired.

Thus, the cone surfaces must be very hard where the cone is to be used in a heavy duty jack. Where the devices are used in radioactive environments, the cone material must be stable to the particle flux. These preferences will readily occur to the metallurgist and engineer faced with the problem of designing a unit for a specific usage. Lubrication of the cone surfaces which are in contact is important to reduce wear and increase efficiency. Any lubrication layer should be thin. However, where the stacked cone(s) have a higher slope angle than the base cone(s) reinforcement and/or additional "lubrication" can be required. The "lubrication" can be in the form of roller or other moving bearings, very high pressure lubricants, etc. This is particularly necessary where heavy loads are involved.

DETAILED DESCRIPTION OF THE DRAWINGS

Figure 1:
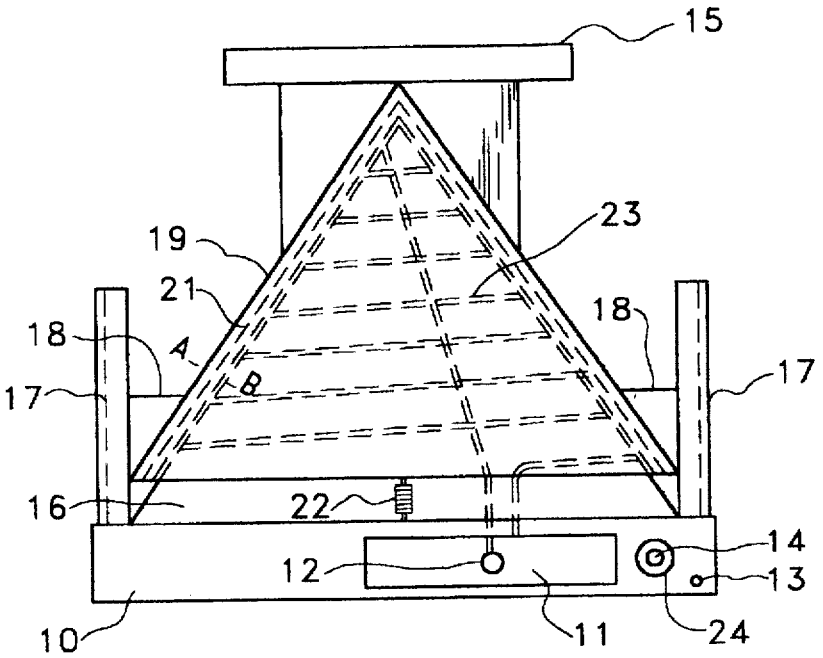
FIG. 1 depicts a portable jack for movements requiring a fine jacking gradient.

FIG. 1 depicts a side view of a portable jack with a rectangular base 10 having a cover 11 for a battery pack (not shown) which is held in place by a knurled knob 12. The unit is activated by "on/off" switch 13 and the rheostat control 14 is used to regulate movement of jack table 15. The jack is made up of base cone 16 which is attached to base 10. "U" shaped guides 17, also attached to base cone 16 enclose the lateral edges of cone extensions 18 and maintain a predetermined alignment of stacked cone 19 and base cone 16. Cone 19 has a polymeric material, e.g., Teflon, coating 21 on its inner surface to provide a desired "lubrication" between cones 16 and 19. Springs 22 (only one shown) are attached to base 10 and stacked cone 19 at an angle, and ensure that stacked cone 19 does not separate from base cone 16 when the unit is being moved. The unit has heating coils 23 connected to the battery pack, the rheostat 14 and switch 13 in series. Markings on knob 24 provide a basis for establishing a desired temperature control.

Figure 2:
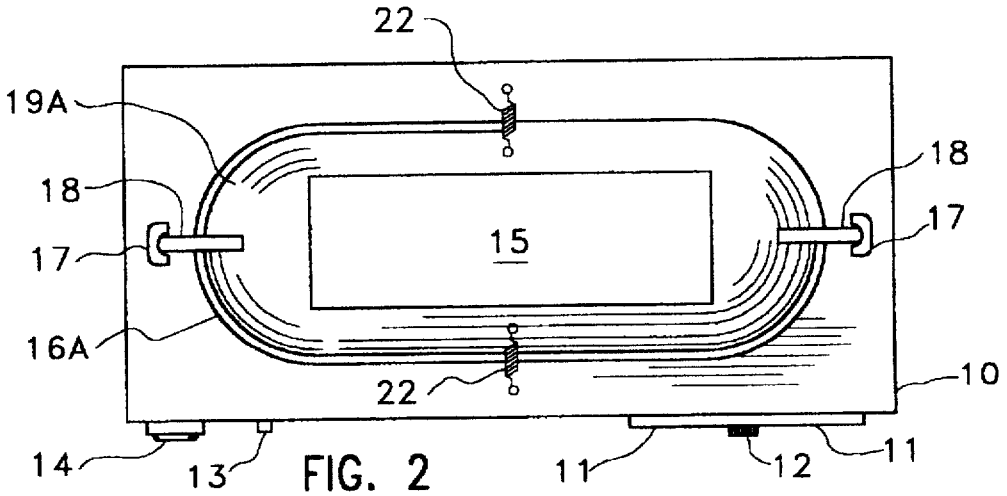
FIG. 2 is a top view of a portable jack where the cones are segments of an ellipse.

FIG. 2 is a top view of a jack similar to that of FIG. 1 with the exception that the hollow geometric form **16*a* and stacked geometric form 19*a*** are sections of an ellipse in shape.

Figure 3:
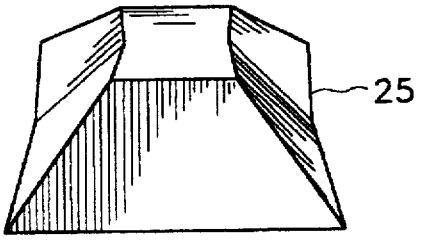
FIG. 3 depicts a base cone which is a truncated modified rectangular pyramid.

FIG. 3 is a perspective view of a base cone 25 in the form of a truncated rectangular pyramid with a slight depression, a "U" in its sides for alignment of other stacked cones.

Figure 4:
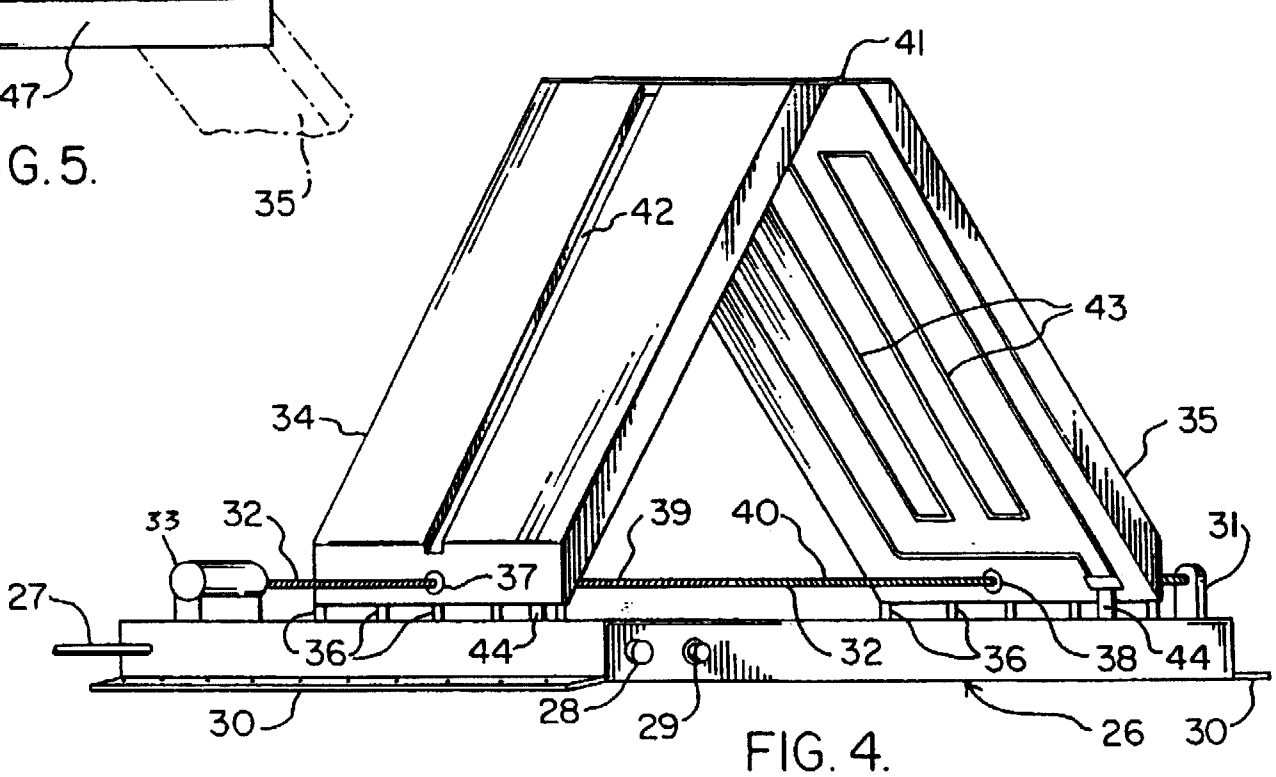
FIG. 4 depicts a truncated base cone which is hinged at the top and can have its base width increased or decreased by mechanical means.

FIG. 4 is a perspective view of a simplified base cone unit for adjusting the distance between two objects. Base 26 has a power supply cable 27 and two control knobs 28 and 29 which, respectively, are used to control the base angle and the temperature of elements 34 and 35. Base 26 has a flange 30 with holes (not shown) for attachment of the base 26 to an object. Base 26 also has on one end a mount 31 for a screw 32 which is attached on the other end of base 26 to a reversible electric motor 33. Motor 33 rotates screw 32 in a desired direction to spread or bring together the base of the two elements 34 and 35 making up, in effect, a truncated segment of a rectangular pyramid. Elements 34 and 35 slide on inverted "T" guides 36 which fit into tracks (See FIG. 6) in base 26. The "T" guides 36 act as an attachment mechanism as well as a friction reducing device. Screw 32 acts through bearings 37 and 38 fixed in elements 34 and 35 and has reversed threads sections 39 and 40 to effect the desired movement of elements 34 and 35. A hinge 41 joins elements 34 and 35 at their upper end.

Cone elements 34 and 35 have grooves 42 (only one shown) in their lateral surfaces to prevent slippages of mating stacked geometric forms. Each of elements 34 and 35 has, on its inner surface, a heating element 43 terminating in flat conduits 44 which are maintained taut within spring loaded reels (not shown) in base 26 to prevent kinking, etc.

Figure 5:
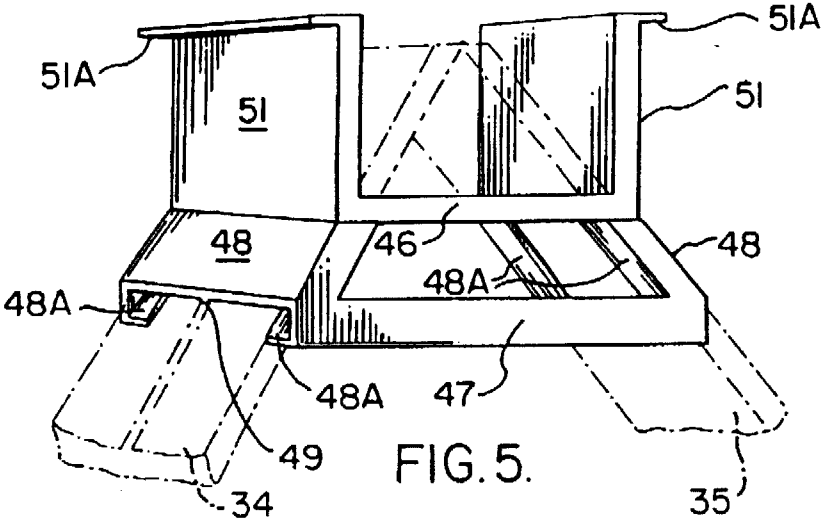
FIG. 5 is a "collar" stacked cone utilizable with the base cone of FIG. 4.

FIG. 5 is a perspective view of a collar for use with the base cone (shown in dashed outline) of FIG. 4. The collar 45 has cross bars 46 and 47 joining plates 48 with their attendant guidance ribs **48*a* and projection 49. Stanchions 51 (with flanges 51*a*) are the upper portions of plates 48** and are attached to an object to be spaced apart from the object to which the base cone unit of FIG. 4 is attached.

The base cone unit of FIG. 4 and collar of FIG. 5 are loosely secured to each other by guidance ribs **48*a* which extend under the edges of elements 34 and 35** of FIG. 4 and are configured to avoid binding within the designed operational temperature ranges.

Figure 6:
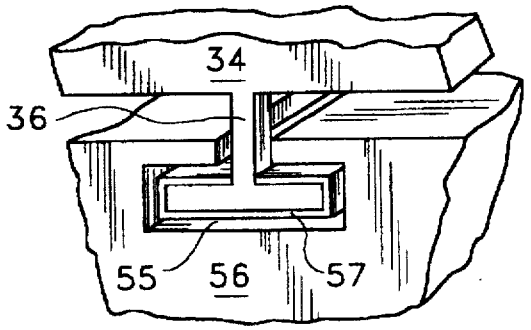
FIG. 6 is a detail of a portion of the base on which the base cone of FIG. 4 rests.

FIG. 6 is a perspective view of a section of a "T" glide 36 of element 34 within a track 55 in the upper surface of base 26. The contact surfaces on the "T" crossbar are coated with a layer 57 of sintered bronze containing a silicone or graphite lubricant.

Figure 7:
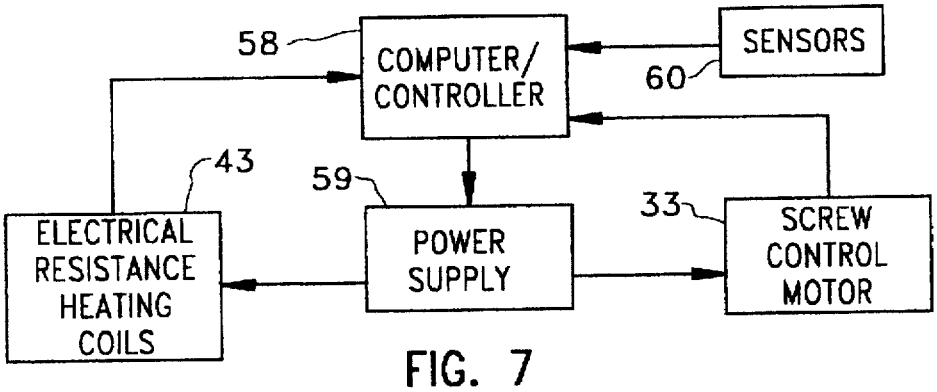
FIG. 7 is a block diagram of an automated electrical system for use with systems combining the elements of FIGS. 4 and 5.

FIG. 7 is a block diagram of the electrical circuitry for an automated control system which can substitute for the manual control system of FIGS. 4 and 5. A computer/controller 58 controls the output of power supply 59 to the electrical resistance coils 43 and screw control motor 33. A thermostat and an inclinometer (not shown) in each of elements 34 and 35 of FIGS. 4 and 5 provides feedback to the computer/controller 58 to ensure proper performance.

Figure 8:
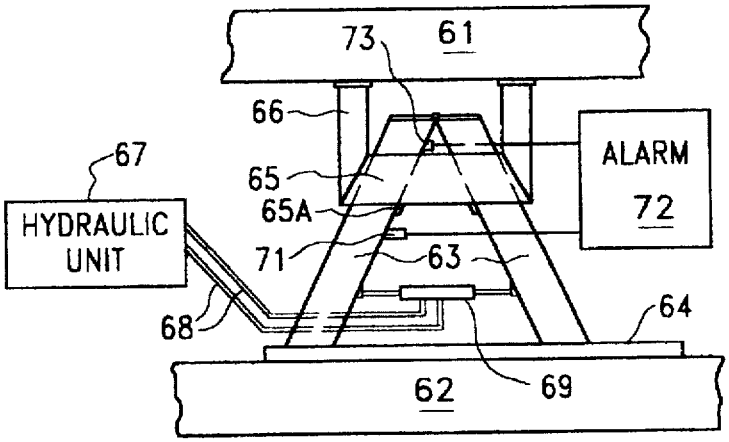
FIG. 8 depicts a hydraulically actuated unit for spacing fuel rods in a nuclear reactor.

FIG. 8 depicts a simplified alarm and cooldown unit for use in controlling the distance between adjacent fuel rods 61 and 62 in a nuclear reactor. A base Invar "cone" 63 attached to rod 62 has glides (not shown) on the bottom of ifs legs extending within tracks (not shown) in glide base 64. A "collar" 65 fits over "cone" 63 and is connected, via extensions 66, to fuel rod 61. Hydraulic unit 67 is used to set the desired distance between fuel rods 61 and 62 via tubing 68 and actuator 69. In the event that ambient temperatures increase, pushing collar 65 toward fuel rod 62, a microswitch 71 is tripped activating alarm 72. If the ambient temperatures fall too much, the microswitch 73 is tripped to actuate alarm 72.

A system utilizing the same concept can increase pressure between hot brakes and a truck brake drum and sound an alarm to ward the driver of the excessive brake temperatures.

Figure 9:
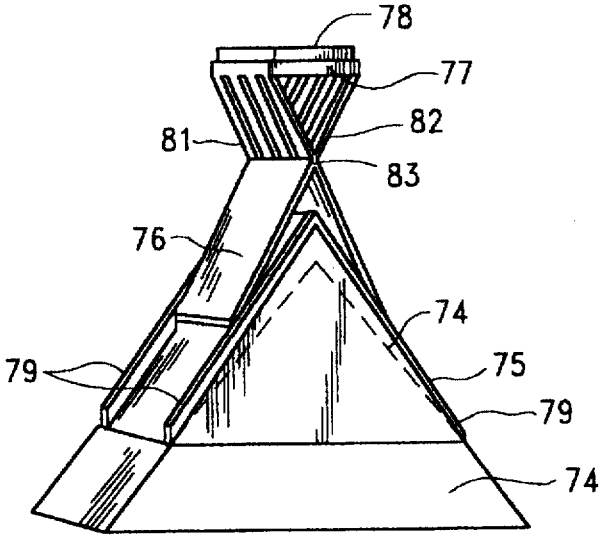
FIG. 9 depicts a triple cone arrangement where heat reduces the effective size of the upper cone.
Figure 10:
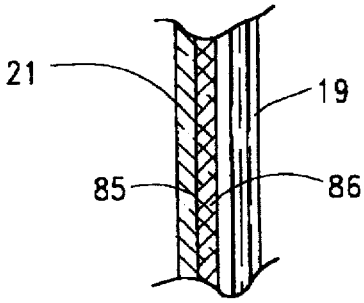
FIG. 10 shows a portion of an A and B metal section.

FIG. 9 depicts a triple cone unit. Base cone 74 is heated by a coil (not shown). Invar "cone" 75 has a greater angle of slope than cone 74 and rises when cone 74 is heated. Cone 76 has a still greater angle of slope, the angle being controlled by heating or cooling input by thermoelectric unit 77 adjacent to heater platform 78.

Cone 75 has a flange 79 on each side to prevent cone 76 from slipping out of place. Cone 76 is made up of two components 81 and 82 making up a scissor held together by pin 83. As the heat from heater 78 expands platform 78 longitudinally, the upper ends of components 81 and 82 are pushed apart with a concomitant reduction in the distance between the bottom edges of components 81 and 82 resting on cone 75. Cooling will increase the angle of the slope.

In an alternative configuration, cone 75 is bimetallic, has a heating unit (not shown) and bends inwardly during heating. In this embodiment, flanges 79 are eliminated and a shallow V like that of FIG. 3 or a shallow concavity is used to ensure that the cones remain in alignment.

In another alternative configuration an A & B metal cone is utilized in the device of FIG. 1 to get substantially only longitudinal expansion and contraction of platform 17. The stacked cone is a portion of a section through a line between A and B of FIG. 1 and is made up of materials 85 and 86 with different coefficients of thermal expansion.

What is claimed is:

1. A device comprising a base cone having a first coefficient of thermal expansion and, at least one stacked cone having at least one other coefficient of thermal expansion, the cones being stacked on each other, and at least one means for changing the temperature of at least one of the base cone and the at least one stacked cone and causing a change in the relative position between the cones.

2. The device of claim 1 further including an alarm means for providing an alarm on the occurrence of predetermined sensed conditions.

3. The device of claim 1 further including a jack adjacent the top stacked cone.

4. The device of claim 1 further including means for connecting the device between at least two objects to control the distance between the objects at least one of which is moveable.

5. The device of claim 1 further including a mechanical means for varying the angle of slope of at least one of the cones.

6. The device of claim 5 further including an electrical actuator for the mechanical means.

7. The device of claim 1 further including a hydraulic means for varying the angle of slope of at least one of the cones.

8. The device of claim 1 connected for operation to control circuitry including a computer/controller means for controlling the device.

9. The device of claim 8 further including sensor means connected to sense the temperature of at least one of the cones.

10. The device of claim 8 wherein the control circuitry further includes a power supply.

11. The device of claim 1 wherein the base cone is made up of at least two parts which are rotationally connected at the top of the cone.

12. The device of claim 1 further including control means for varying the angle of the slope of the at least one stacked cone.

13. The device of claim 12 wherein a thermoelectric element is used to control a variable slope angle of said at least one stacked cone.

14. The device of claim 12 wherein an "A+B metal" element is used to control the variable slope angle.

15. The device of claim 1 wherein at least the base cone has attachment means for connecting the base cone to a base including means for reducing friction between the base cone and the base.

16. The device of claim 1 further including means for maintaining a predetermined alignment of the stacked cones.

17. The device of claim 1 further including a lubricant to facilitate movement between the cones.

18. The device of claim 17 wherein the lubricant is a polymeric material.

19. The device of claim 1 including, at the lower edge of the at least one one stacked cone, a moving means for reducing wear where the stacked cones move relative to each other.

* * * * *